US008801877B2

(12) United States Patent
Semba et al.

(10) Patent No.: US 8,801,877 B2
(45) Date of Patent: Aug. 12, 2014

(54) AUSTENITIC HEAT RESISTANT ALLOY, HEAT RESISTANT PRESSURE MEMBER COMPRISING THE ALLOY, AND METHOD FOR MANUFACTURING THE SAME MEMBER

(71) Applicant: Nippon Steel & Sumitomo Metal Corporation, Tokyo (JP)

(72) Inventors: Hiroyuki Semba, Sanda (JP); Hirokazu Okada, Kobe (JP); Masaaki Igarashi, Sanda (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/908,027

(22) Filed: Jun. 3, 2013

(65) Prior Publication Data

US 2013/0263974 A1 Oct. 10, 2013

Related U.S. Application Data

(60) Division of application No. 12/965,954, filed on Dec. 13, 2010, now abandoned, which is a continuation of application No. PCT/JP2009/060837, filed on Jun. 15, 2009.

(30) Foreign Application Priority Data

Jun. 16, 2008 (JP) ..... 2008-156352

(51) Int. Cl.
*C22F 1/10* (2006.01)
*C22F 1/00* (2006.01)

(52) U.S. Cl.
USPC ..... 148/707; 148/442; 148/501; 148/506; 420/584.1; 420/586

(58) Field of Classification Search
USPC ..... 148/442, 707, 501, 506; 420/584.1, 586
See application file for complete search history.

(56) References Cited

U.S. PATENT DOCUMENTS

| | | | |
|---|---|---|---|
| 5,543,109 A | 8/1996 | Semba et al. | |
| 6,926,778 B2 | 8/2005 | Iseda et al. | |
| 2005/0045251 A1* | 3/2005 | Nishiyama et al. | 148/327 |

FOREIGN PATENT DOCUMENTS

| | | |
|---|---|---|
| CN | 1451778 | 10/2003 |
| CN | 101151394 | 3/2008 |
| EP | 1 357 198 | 10/2003 |
| EP | 1 498 508 | 1/2005 |
| JP | 60-100640 | 6/1985 |
| JP | 61-174350 | 8/1986 |
| JP | 61-276948 | 12/1986 |
| JP | 62-063654 | 3/1987 |
| JP | 64-055352 | 3/1989 |
| JP | 02-200756 | 8/1990 |
| JP | 03-264641 | 11/1991 |
| JP | 07-034166 | 2/1995 |
| JP | 07-070681 | 3/1995 |
| JP | 07-216511 | 8/1995 |
| JP | 07-331390 | 12/1995 |
| JP | 08-127848 | 5/1996 |
| JP | 08-218140 | 8/1996 |
| JP | 10-001754 | 1/1998 |
| JP | 10-096038 | 4/1998 |
| JP | 2004-003000 | 1/2004 |
| JP | 2005-048284 | 2/2005 |

OTHER PUBLICATIONS

Machine translation of JP 2004003000, 2004.*

* cited by examiner

*Primary Examiner* — Rebecca Lee
(74) *Attorney, Agent, or Firm* — Clark & Brody

(57) ABSTRACT

An austenitic heat resistant alloy, which comprises by mass percent, C: over 0.02 to 0.15%, Si≤2%, Mn≤3%, P≤0.03%, S≤0.01%, Cr: 28 to 38%, Ni: over 40 to 60%, Co≤20% (including 0%), W over 3 to 15%, Ti: 0.05 to 1.0%, Zr: 0.005 to 0.2%, Al: 0.01 to 0.3%, N≤0.02%, and Mo<0.5%, with the balance being Fe and impurities, in which the following formulas (1) to (3) are satisfied has high creep rupture strength and high toughness after a long period of use at a high temperature, and further it is excellent in hot workability. This austenitic heat resistant alloy may contain a specific amount of one or more elements selected from Nb, V, Hf, B, Mg, Ca, Y, La, Ce, Nd, Sc, Ta, Re, Ir, Pd, Pt and Ag. $P \leq 3/\{200(Ti+8.5\times Zr)\}$ . . . (1), $1.35\times Cr \leq Ni+Co \leq 1.85\times Cr$ . . . (2), $Al \geq 1.5\times Zr$ . . . (3).

2 Claims, No Drawings

AUSTENITIC HEAT RESISTANT ALLOY, HEAT RESISTANT PRESSURE MEMBER COMPRISING THE ALLOY, AND METHOD FOR MANUFACTURING THE SAME MEMBER

"This application is a Divisional of U.S. Ser. No. 12/965,954 filed on Dec. 13, 2010, which is a Continuation of PCT/JP2009/060837 filed on Jun. 15, 2009, which is published as WO2009/154161 on Dec. 23, 2009."

TECHNICAL FIELD

The present invention relates to an austenitic heat resistant alloy, which has a high temperature strength far higher than that of a conventional heat resistant alloy, and is excellent in toughness after a long period of use, and also excellent in hot workability, and relates to a heat resistant pressure member comprising the said alloy, and also a method for manufacturing the same member. More particularly, the present invention relates to an austenitic heat resistant alloy which contains 28 to 38 mass % of Cr, which is excellent in high temperature strength, especially creep rupture strength, and is excellent in toughness after a long period of use due to high structural stability. Further it has remarkably improved hot workability, especially high temperature ductility at 1150° C. or higher, being used as a pipe material, a plate material for a heat resistant pressure member, a bar material, forgings, and the like for a boiler for power generation, a plant for chemical industry, and the like, and relates to a heat resistant pressure member comprising the said alloy, and a method for manufacturing the same member.

BACKGROUND ART

Conventionally, for a boiler used in a high temperature environment, a chemical plant, and the like, a so-called "18-8 type austenitic stainless steel" such as SUS 304H, SUS 316H, SUS 321H, SUS 347H, and the like has been used as an equipment material.

However, in recent years, the conditions under which this equipment was used in a high temperature environment have become extremely severe, and therefore the performance requirements of material to be used have become stringent; under these circumstances, the above-described 18-8 type austenitic stainless steel, having been used conventionally, has become remarkably insufficient in high temperature strength, especially creep rupture strength. Therefore, in order to solve the said problem, an austenitic stainless steel, with improved creep rupture strength, has been developed by containing proper amounts of various elements.

On the other hand, nowadays, in the field of a boiler for thermal power generation, for example, a project is underway to raise steam temperature, which has conventionally been about 600° C. at the most, to 700° C. or higher. In this case, the temperature of a member to be used far exceeds 700° C., and therefore, even if the above-described newly developed austenitic stainless steel is used, the creep rupture strength and corrosion resistance are insufficient.

Generally, in order to improve the corrosion resistance, it is effective to increase the content of Cr in the steel. However, in the case where the Cr content is increased, for example, as seen in SUS 310S which contains about 25 mass % of Cr, the creep rupture strength at 600 to 800° C. rather becomes lower than that of 18-8 type stainless steels, and the toughness is deteriorated due to the precipitation of σ phase. Further, even if the Cr content is increased, about 25 mass % of Cr cannot provide sufficient corrosion resistance in a severe corrosive environment.

Thus, the Patent Documents 1 to 7 disclose heat resistant alloys in which the contents of Cr and Ni are increased, and moreover one or more kinds of Mo and W are contained in order to improve the creep rupture strength as high temperature strength.

Further, in order to meet the increasingly stringent requirements for high temperature strength characteristics, especially the requirements for creep rupture strength, the Patent Document 8 discloses a heat resistant alloy which contains, by mass %, 28 to 38% of Cr and 30 to 50% of Ni, and the Patent Documents 9 to 14 disclose heat resistant alloys which contain, by mass %, 28 to 38% of Cr and 35 to 60% of Ni. For all of the heat resistant alloys proposed in the Patent Documents 8 to 14, the creep rupture strength is further improved by utilizing the precipitation of α-Cr phase of a body-centered cubic structure consisting mainly of Cr.

CITATION LIST

Patent Document

Patent Document 1: JP 60-100640 A
Patent Document 2: JP 61-174350 A
Patent Document 3: JP 61-276948 A
Patent Document 4: JP 62-63654 A
Patent Document 5: JP 64-55352 A
Patent Document 6: JP 2-200756 A
Patent Document 7: JP 3-264641 A
Patent Document 8: JP 7-34166 A
Patent Document 9: JP 7-70681 A
Patent Document 10: JP 7-216511 A
Patent Document 11: JP 7-331390 A
Patent Document 12: JP 8-127848 A
Patent Document 13: JP 8-218140 A
Patent Document 14: JP 10-96038 A

SUMMARY OF THE INVENTION

Problems to be Solved by the Invention

The heat resistant alloys disclosed in the Patent Documents 1 to 7 cannot necessarily obtain sufficiently high creep rupture strength in a severe environment in which the steam temperature is 700° C. or higher.

Also, it cannot be said that the heat resistant alloys disclosed in the Patent Documents 8 to 14 are sufficient in creep rupture strength that has been required to be high in recent years. Further, the heat resistant alloys disclosed in the Patent Documents 8 to 14 are sometimes insufficient in toughness after a long period of use depending on the alloy composition thereof. Moreover, regarding these heat resistant alloys, it has been desired to further improve the hot workability, especially the hot workability on the high temperature side of 1150° C. or higher. The reason for this is that in a case where a seamless steel pipe is manufactured by using a material having a poor hot workability, the seamless steel pipe is often manufactured by the hot extrusion process, and if the hot workability on the high temperature side of 1150° C. or higher is insufficient, the internal temperature of the material becomes higher than the heating temperature due to a work heat generation, so that defects, such as two-piece cracks and scabs, are formed. If the hot workability on the high temperature side of 1150° C. or higher is insufficient, in a piercing process using a piercing mill of, for example, a Mannesmann-mandrel mill system, the above-described defects are formed in the same way.

In view of the above-mentioned state of affairs, the objective of the present invention is to provide an austenitic heat resistant alloy containing 28 to 38 mass % of Cr, which has high temperature strength, especially creep rupture strength, which is far higher than that of the conventional heat resistant alloys, especially the heat resistant alloys disclosed in the Patent Documents 8 to 14. It has high toughness because the structural stability is excellent even after a long period of use at a high temperature, and further it has remarkably improved hot workability, especially high temperature ductility at 1150° C. or higher.

Means for Solving the Problems

The present inventors examined the creep rupture strength, structural stability in a long period of use, hot workability, and the like by using various heat resistant alloys containing, by mass %, 28 to 38% of Cr and more than 40% to not more than 60% of Ni as base components and capable of utilizing precipitation strengthening of the α-Cr phase. As a result, the present inventors obtained the following findings (a) to (g).

(a) If a proper amount of W is contained, an $Fe_2W$ type Laves phase and/or an $Fe_7W_6$ type μ phase precipitate, and therefore the creep rupture strength is significantly improved.

(b) In the case where 28 to 38% of Cr is contained, and if W can be dissolved into the precipitated α-Cr phase, the growing and coarsening of the α-Cr phase during a long period of use at a high temperature are restrained, a sudden decrease in creep rupture strength on the long time side does not occur.

(c) Conventionally, it has generally been thought that Mo and W have equivalent operational advantages; however, in the case where Mo is compositely contained in an alloy containing W and 28 to 38% of Cr, the σ phase sometimes precipitates on the long time side. Therefore, the creep rupture strength, ductility, and toughness may decrease.

(d) By properly controlling the content of Ni, which is an austenite stabilizing element, with respect to the Cr content, the precipitation of the σ phase during a long period of use at a high temperature can be restrained stably and reliably, and moreover, the optimum amount of α-Cr phase can be precipitated. In the case where the alloy compositely contains Co, by controlling the contents of Ni and Co with respect to the Cr content so that the sum of the contents of Ni and Co (that is, "Ni+Co") is proper, the precipitation of the σ phase, during a long period of use at a high temperature, can be restrained stably and reliably, and moreover, the optimum amount of α-Cr phase can be precipitated.

(e) Zr, which has generally been known as a "grain boundary strengthening element", is competent for improving the creep rupture strength in the case of the heat resistant alloy capable of utilizing the precipitation strengthening of α-Cr phase. Further, by properly controlling the content of Al in accordance with the content of Zr, the creep rupture strength is significantly improved.

(f) Ti also improves the creep rupture strength of the heat resistant alloy capable of utilizing the precipitation strengthening of α-Cr phase. By containing Ti compositely with Zr, the precipitation of α-Cr phase is further promoted, whereby the creep rupture strength can be further enhanced.

(g) Since Ti and Zr lower the melting point of the heat resistant alloy, the hot workability, especially the hot workability on the high temperature side of 1150° C. or higher, decreases, and further the high temperature crack resistance at the time of welding may decrease. However, by properly controlling the content of P in accordance with the contents of Ti and Zr, the hot workability on the high temperature side of 1150° C. or higher can be improved stably and reliably while a high creep rupture strength is maintained. Further, the high temperature crack resistance at the time of welding can be improved.

The present invention has been accomplished on the basis of the above-described findings. The main points of the present invention are austenitic heat resistant alloys shown in the following (1) to (3), a heat resistant pressure member shown in the (4), and a method for manufacturing a heat resistant pressure member shown in the (5).

(1) An austenitic heat resistant alloy, which comprises by mass percent, C: more than 0.02% to not more than 0.15%, Si: 2% or less, Mn: 3% or less, P: 0.03% or less, S: 0.01% or less, Cr: 28 to 38%, Ni: more than 40% to not more than 60%, W: more than 3% to not more than 15%, Ti: 0.05 to 1.0%, Zr: 0.005 to 0.2%, Al: 0.01 to 0.3%, N: 0.02% or less, and Mo: less than 0.5%, with the balance being Fe and impurities, in which the following formulas (1) to (3) are satisfied:

$$P \leq 3/\{200(Ti+8.5\times Zr)\} \quad (1),$$

$$1.35\times Cr \leq Ni \leq 1.85\times Cr \quad (2),$$

$$Al \geq 1.5\times Zr \quad (3);$$

wherein each element symbol in the equations (1) to (3) represents the content by mass % of the element concerned.

(2) An austenitic heat resistant alloy, which comprises by mass percent, C: more than 0.02% to not more than 0.15%, Si: 2% or less, Mn: 3% or less, P: 0.03% or less, S: 0.01% or less, Cr: 28 to 38%, Ni: more than 40% to not more than 60%, Co: 20% or less, W: more than 3% to not more than 15%, Ti: 0.05 to 1.0%, Zr: 0.005 to 0.2%, Al: 0.01 to 0.3%, N: 0.02% or less, and Mo: less than 0.5%, with the balance being Fe and impurities, in which the following formulas (1), (3) and (4) are satisfied:

$$P \leq 3/\{200(Ti+8.5\times Zr)\} \quad (1),$$

$$Al \leq 1.5\times Zr \quad (3),$$

$$1.35\times Cr \leq Ni+Co \leq 1.85\times Cr \quad (4);$$

wherein each element symbol in the equations (1), (3) and (4) represents the content by mass % of the element concerned.

(3) The austenitic heat resistant alloy according to the above (1) or (2), which further contains, by mass percent, one or more elements of one or more groups selected from the ⟨1⟩ to ⟨3⟩ groups listed below in lieu of a part of Fe:

⟨1⟩ Nb: 1.0% or less, V: 1.5% or less, Hf: 1% or less and B: 0.05% or less;

⟨2⟩ Mg: 0.05% or less, Ca: 0.05% or less, Y: 0.5% or less, La: 0.5% or less, Ce: 0.5% or less, Nd: 0.5% or less and Sc: 0.5% or less;

⟨3⟩ Ta: 8% or less, Re: 8% or less, Ir: 5% or less, Pd: 5% or less, Pt: 5% or less and Ag: 5% or less.

(4) A heat resistant pressure member excellent in creep resistance properties and structural stability in a high temperature range, which is made from the austenitic heat resistant alloy according to any one of the above (1) to (3).

(5) A method for manufacturing the heat resistant pressure member excellent in creep resistance and structural stability in a high temperature range according to the above (4), wherein the austenitic heat resistant alloy according to any one of the above (1) to (3) is treated in sequence by the following steps (i), (ii) and (iii):

step (i): heating to 1050 to 1250° C. at least once before final hot or cold working;

step (ii): carrying out a final hot or cold plastic working such that the reduction of area is 10% or more;

step carrying out a final heat treatment in which cooling is performed after heating and holding at a temperature in the range of 1100 to 1250° C.

The term "impurities" so referred to in the phrase "the balance being Fe and impurities" indicates those impurities which come from ores and scraps as raw materials, environments, and so on in the industrial production of alloys. Also, the "high temperature range" is a temperature range in which creep deformation occurs, and means a temperature range of 600° C. or higher in the alloy of the present invention, and about 600 to 900° C. considering the upper limit in terms of strength.

Effects of the Invention

The austenitic heat resistant alloy according to the present invention, has high temperature strength, especially creep rupture strength, higher than that of the conventional heat resistant alloys, and also has high toughness because the structural stability is excellent even after a long period of use at a high temperature. Further it is excellent in hot workability, especially high temperature ductility at 1150° C. or higher. Therefore, this austenitic heat resistant alloy can be suitably used as a pipe material, a plate material for a heat resistant pressure member, a bar material, forgings, and the like for a boiler for power generation, a plant for chemical industry and so on.

MODES FOR CARRYING OUT THE INVENTION

Hereunder, the requirements of the present invention are described in detail. In the following description, the symbol "%" for the content of each element means "% by mass".

(A) Austenitic Heat Resistant Alloy

C: More than 0.02% to not More than 0.15%

C (carbon) forms carbides which have an effect of ensuring tensile strength and creep rupture strength that are necessary when the alloy is used in a high temperature environment. In order to obtain this effect, a content of C more than 0.02% is necessary. However, even if an amount of more than 0.15% of C is contained, the amount of undissolved carbides after the solution heat treatment merely increases; C does not contribute to the improvement in high temperature strength, and other mechanical properties such as toughness and the weldability are deteriorated. Therefore, the content of C is set to more than 0.02% to not more than 0.15%. The preferable content range of C is more than 0.03% to not more than 0.13%, and the further preferable range thereof is more than 0.05% to not more than 0.12%.

Si: 2% or Less

Si (silicon) is added as a deoxidizing element. Si also is an element effective in raising oxidation resistance, steam oxidation resistance and so on. However, if the Si content increases and especially exceeds 2%, the formation of intermetallic compounds such as the σ phase is promoted, so that the structural stability at high temperatures is deteriorated, and the toughness and ductility decrease. Further, the weldability and hot workability are deteriorated. Therefore, the content of Si is set to 2% or less. In the case where much importance is attached to the toughness and ductility, the content of Si is preferably set to 1% or less. In the case where the deoxidizing action has been ensured by any other element, it is not necessary to regulate the lower limit of the Si content.

In a case where much importance is attached to the deoxidizing action, oxidation resistance, steam oxidation resistance, and the like, the content of Si is preferably 0.05% or more, further preferably 0.1% or more.

Mn: 3% or Less

Like Si, Mn (manganese) has a deoxidizing effect. Mn also has the effect of fixing S, which is inevitably contained in the alloy, as sulfides, and therefore Mn does improve the hot workability. However, if the Mn content exceeds 3%, the precipitation of intermetallic compounds, such as the σ phase is promoted, so that the structural stability and the mechanical properties, such as high temperature strength, are deteriorated. Therefore, the content of Mn is set to 3% or less.

It is not necessary to regulate the lower limit of the Mn content; however in the case where much importance is attached to the action for improving hot workability, the content of Mn is preferably set to 0.1% or more. The content of Mn is further preferably set to 0.2 to 2%, still further preferably set to 0.2 to 1.5%.

P: 0.03% or Less

P (phosphorus) is inevitably incorporated in the alloy as an impurity, and deteriorates the hot workability. In particular, if the content of P exceeds 0.03%, the hot workability deteriorates remarkably. Therefore, the content of P is set to 0.03% or less.

In addition to being limited to 0.03% or less, the content of P must satisfy the following formula:

$$P \leq 3/\{200(Ti+8.5\times Zr)\} \quad (1),$$

S: 0.01% or Less

Like P, S (sulfur) is inevitably incorporated in the alloy as an impurity, and deteriorates the hot workability. In particular, if the content of S exceeds 0.01%, the remarkable deterioration of hot workability occurs. Therefore, the content of S is set to 0.01% or less.

In the case where it is desired to ensure excellent hot workability, the content of S is preferably set to 0.005% or less, further preferably set to 0.003% or less.

Cr: 28 to 38%

Cr (chromium) has the effect of improving the corrosion resistance such as oxidation resistance, steam oxidation resistance, and high temperature corrosion resistance. Further, in the present invention, Cr is an element that is essential in precipitating as α-Cr phase which enhances the creep rupture strength. However, if the content of Cr is less than 28%, these effects cannot be obtained. On the other hand, if the Cr content increases and especially exceeds 38%, the hot workability is deteriorated, and further the structural stability is impaired by the precipitation of σ phase and the like. Therefore, the content of Cr is set to 28 to 38%. An amount more than 30% of Cr content is preferable.

Ni: More than 40% to not More than 60%

Ni (nickel) is an element that is essential in ensuring a stable austenitic microstructure. In the present invention, since 28 to 38% of Cr is contained, in order to restrain the precipitation of the σ phase and to stably precipitate α-Cr phase, a content of Ni more than 40% is necessary. However, if the content of Ni becomes excessive and especially exceeds 60%, depending on the content of Cr, the α-Cr phase does not precipitate sufficiently, and the economic efficiency is damaged. Therefore, the content of Ni is set to more than 40% to not more than 60%.

In addition to being limited to more than 40% to not more than 60%, the content of Ni must satisfy the following formula:

$$1.35\times Cr \leq Ni \leq 1.85\times Cr \quad (2),$$

or, in the case where the later-described amount of Co is compositely contained, the content of Ni must satisfy the following formula:

$$1.35\times Cr \leq Ni+Co \leq 1.85\times Cr \quad (4).$$

W: More than 3% to not More than 15%

W (tungsten) is a very important element that not only contributes to the improvement in creep rupture strength as a solid solution strengthening element by dissolving into the matrix but also significantly improves the creep rupture strength by precipitating as an $Fe_2W$ type Laves phase or an $Fe_7W_6$ type μ phase. Further, in the present invention, since 28 to 38% of Cr is contained, W dissolves into the precipitated α-Cr phase, restraining the growing and coarsening of α-Cr phase during a long period of use at a high temperature, and inhibiting a sudden decrease in creep rupture strength on the long time side. However, if the content of W is 3% or less, the above-described effects cannot be obtained. On the other hand, even if an amount more than 15% of W is contained, the effects saturate and only the cost increases, and moreover, the structural stability and hot workability are deteriorated. Therefore, the content of W is set to more than 3% to not more than 15%. The content of W is preferably set to more than 3% to not more than 13%. In the case where much importance is further attached to the effect of improving the creep rupture strength, the content of W is further preferably set to more than 6% to not more than 13%.

Ti: 0.05 to 1.0%

Ti (titanium) is an important element that promotes the precipitation of α-Cr phase and thereby enhances the creep rupture strength. In particular, by containing Ti compositely with the later-described amount of Zr; the precipitation of α-Cr phase is further promoted, so that the creep rupture strength can further be enhanced. However, if the content of Ti is less than 0.05%, sufficient effects cannot be obtained. On the other hand, if the content of Ti exceeds 1.0%, the hot workability deteriorates. Therefore, the content of Ti is set to 0.05 to 1.0%. The content of Ti is preferably set to 0.1 to 0.9%, further preferably set to 0.2 to 0.9%. The still further preferable upper limit of the content of Ti is 0.5%.

In addition to being limited to 0.05 to 1.0%, the content of Ti must satisfy the following formula:

$$P \leq 3/\{200(Ti+8.5\times Zr)\} \quad (1),$$

Zr: 0.005 to 0.2%

Like Ti, Zr (zirconium) is an important element that promotes the precipitation of α-Cr phase and thereby enhances the creep rupture strength. In particular, by containing Zr compositely with the above-described amount of Ti, the precipitation of α-Cr phase is further promoted, so that the creep rupture strength can further be enhanced. However, if the content of Zr is less than 0.005%, sufficient effects cannot be obtained. On the other hand, if the content of Zr exceeds 0.2%, the hot workability deteriorates. Therefore, the content of Zr is set to 0.005 to 0.2%. The content of Zr is preferably set to 0.01 to 0.1% and more preferably set to 0.01 to 0.05%.

In addition to being limited to 0.005 to 0.2%, the content of Zr must satisfy the following two formulas:

$$P \leq 3/\{200(Ti+8.5\times Zr)\} \quad (1),$$

$$Al \geq 1.5\times Zr \quad (3);$$

Al: 0.01 to 0.3%

Al (aluminum) is an element having the effect of deoxidizing, and in order to obtain the said effect, the content of Al should be 0.01% or more. In the case where much Al is contained, the creep rupture strength can be enhanced by the precipitation of Y' phase. In the present invention, however, since the proper amounts of W, Ti and Zr are contained, and the creep rupture strength can be enhanced dramatically by the composite precipitation strengthening due to α-Cr phase, Laves phase, and the like, the strengthening due to Y' phase is not necessary. Moreover, in the case where the content of Al exceeds 0.3%, the hot workability, ductility, and toughness may be deteriorated. Therefore, attaching much importance to hot workability, ductility, and toughness, the content of Al is set to 0.01 to 0.3%.

In addition to being limited to 0.01 to 0.3%, the content of Al must satisfy the following formula:

$$Al \geq 1.5\times Zr \quad (3);$$

N: 0.02% or Less

In the present invention in which Zr and Ti are contained as essential elements to promote the precipitation of α-Cr phase, N (nitrogen), which is an element contained inevitably in the ordinary melting method, must be decreased in content as far as possible to avoid the consumption of Zr and Ti caused by the formation of ZrN and TiN. However, an extreme decrease in N content lowers the economic efficiency because of the necessity of the special melting method and high purity raw material. Therefore, the content of N is set to 0.02% or less. The content of N is preferably 0.015% or less.

Mo: Less than 0.5%

Mo (molybdenum) has conventionally been thought to be an element that dissolves into the matrix and contributes to the improvement in creep rupture strength as a solid solution strengthening element and that has the action equivalent to that of W. However, by the studies of the present inventors, it turned out that in the case where Mo is compositely contained in the alloy containing the above-described amounts of W and Cr, the σ phase may precipitate on the long time side, and therefore the creep rupture strength, ductility, and toughness may deteriorate. Consequently, the content of Mo is preferably as low as possible, and so, the content thereof is set to less than 0.5%. The content of Mo is further preferably limited to less than 0.2%.

One austenitic heat resistant alloy of the present invention comprises the above-described elements with the balance being Fe and impurities. Another austenitic heat resistant alloy of the present invention contains Co in the amount described below in addition to the above-described elements.

Co: 20% or Less

Like Ni, Co (cobalt) is an element that has the effect of stabilizing the austenitic microstructure. Co also contributes to the improvement in creep rupture strength. And therefore, Co may be contained to obtain the above-described effects. However, even if the content of Co exceeds 20%, the above-described effects saturate and the cost increases, and moreover the hot workability is also deteriorated. Therefore, in the case where Co is contained, the content of Co is set to 20% or less. The upper limit of the Co content is preferably set to 15%. On the other hand, in order to ensure the above-described effects of stabilizing the austenitic microstructure and of improving the creep rupture strength due to the Co, the lower limit of the Co content is preferably set to 0.05% and more preferably set to 0.5%.

In the case where Co is contained, in addition to being limited to 20% or less, the content of Co must satisfy the following formula:

$$1.35\times Cr \leq Ni+Co \leq 1.85\times Cr \quad (4).$$

Another austenitic heat resistant alloy of the present invention further contains, in addition to the above-described elements of C to Mo or in addition to the above-described elements of C to Co, one or more elements of one or more groups selected from the ⟨1⟩ to ⟨3⟩ groups listed below in lieu of a part of Fe:

⟨1⟩ Nb: 1.0% or less, V: 1.5% or less, Hf: 1% or less, and B: 0.05% or less;

⟨2⟩ Mg: 0.05% or less, Ca: 0.05% or less, Y: 0.5% or less, La: 0.5% or less, Ce: 0.5% or less, Nd: 0.5% or less, and Sc: 0.5% or less;

⟨3⟩ Ta: 8% or less, Re: 8% or less, Ir: 5% or less, Pd: 5% or less, Pt: 5% or less, and Ag: 5% or less.

Hereunder, the above-mentioned elements will be explained.

Each of Nb, V, Hf and B being elements of the ⟨1⟩ group, has the effects of enhancing the high temperature strength and creep rupture strength. Therefore, in the case where it is desired to obtain the enhanced high temperature strength and creep rupture strength, these elements are added positively, and one or more elements among them may be contained in the range described below.

Nb: 1.0% or Less

Nb (niobium) has the effects of enhancing the high temperature strength and creep rupture strength by forming carbo-nitrides and also it improves the ductility by making the grains fine. Therefore, in order to obtain these effects, Nb may be contained. However, if the content of Nb exceeds 1.0%, the hot workability and toughness are deteriorated. Therefore, in the case where Nb is contained, the content of Nb is set to 1.0% or less. The upper limit of the Nb content is preferably set to 0.9%. On the other hand, in order to ensure the above-described effects of enhancing the high temperature strength, creep rupture strength, and ductility due to Nb, the lower limit of the Nb content is preferably set to 0.05% and further preferably set to 0.1%.

V: 1.5% or Less

V (vanadium) has the effects of enhancing the high temperature strength and creep rupture strength by forming carbo-nitrides. Therefore, in order to obtain these effects, V may be contained. However, if the content of V exceeds 1.5%, the high temperature corrosion resistance is deteriorated, and further the ductility and toughness are decreased due to the precipitation of brittle phase. Therefore, in the case where V is contained, the content of V is set to 1.5% or less. The upper limit of the V content is preferably set to 1%. On the other hand, in order to ensure the above-described effects of enhancing the high temperature strength and creep rupture strength due to V, the lower limit of the V content is preferably set to 0.02% and more preferably set to 0.04%.

Hf: 1% or Less

Hf (hafnium) contributes to precipitation strengthening as a carbo-nitride and has the effects of enhancing the high temperature strength and creep rupture strength. Therefore, in order to obtain these effects, Hf may be contained. However, if the content of Hf exceeds 1%, the workability and weldability are impaired. Therefore, in the case where Hf is contained, the content of Hf is set to 1% or less. The upper limit of the Hf content is preferably set to 0.8% and more preferably set to 0.5%. On the other hand, in order to ensure the above-described effects of enhancing the high temperature strength and creep rupture strength due to Hf, the lower limit of the Hf content is preferably set to 0.01% and further preferably set to 0.02%.

B: 0.05% or Less

B (boron) exists at grain boundaries as a single form or it exists in carbo-nitrides. B has the effects of enhancing the high temperature strength and creep rupture strength by restraining a grain boundary slip caused by grain boundary strengthening during the use at a high temperature and also by promoting the fine dispersing precipitation of carbo-nitrides. However, if the content of B exceeds 0.05%, the weldability is deteriorated. Therefore, in the case where B is contained, the content of B is set to 0.05% or less. The upper limit of the B content is preferably set to 0.01% and more preferably set to 0.005%. On the other hand, in order to ensure the above-described effects of enhancing the high temperature strength and creep rupture strength due to B, the lower limit of the B content is preferably set to 0.0005% and further preferably set to 0.001%.

The upper limit of the sum of the contents of the above-described elements from Nb to B may be 3.55%. The upper limit of the sum of contents thereof is further preferably 2.5%.

Each of Mg, Ca, Y, La, Ce, Nd and Sc being elements of the (2) group, has the effect of improving the hot workability by fixing S as sulfides. Therefore, in the case where it is desired to obtain further excellent hot workability, these elements are added positively, and one or more elements among them may be contained in the range described below.

Mg: 0.05% or Less

Mg (magnesium) has the effect of improving the hot workability by fixing S, which is contained inevitably in the alloy, as sulfides. Therefore, in order to obtain this effect, Mg may be contained. However, if the content of Mg exceeds 0.05%, the cleanliness of the alloy is deteriorated, and the hot workability and ductility are contrarily impaired. Therefore, in the case where Mg is contained, the content of Mg is set to 0.05% or less. The upper limit of the Mg content is preferably set to 0.02% and more preferably set to 0.01%. On the other hand, in order to ensure the above-described effect of improving the hot workability due to Mg, the lower limit of the Mg content is preferably set to 0.0005% and further preferably set to 0.001%.

Ca: 0.05% or Less

Ca (calcium) has the effect of improving the hot workability by fixing S, which inhibits the hot workability, as sulfides. Therefore, in order to obtain this effect, Ca may be contained, however, if the content of Ca exceeds 0.05%, the cleanliness of the alloy is deteriorated, and the hot workability and ductility are contrarily impaired. Therefore, in the case where Ca is contained, the content of Ca is set to 0.05% or less. The upper limit of the Ca content is preferably set to 0.02% and more preferably set to 0.01%. On the other hand, in order to ensure the above-described effect of improving the hot workability due to Ca, the lower limit of the Ca content is preferably set to 0.0005% and further preferably set to 0.001%.

Y: 0.5% or Less

Y (yttrium) has the effect of improving the hot workability by fixing S as sulfides. Y also has the effect of improving the adhesiveness of a $Cr_2O_3$ protective film on the alloy surface, especially improving the oxidation resistance at the time of repeated oxidation, and further Y has the effects of enhancing the creep rupture strength and creep rupture ductility by contributing to grain boundary strengthening. However, if the content of Y exceeds 0.5%, the amounts of inclusions, such as oxides increase, so that the workability and weldability are impaired. Therefore, in the case where Y is contained, the content of Y is set to 0.5% or less. The upper limit of the Y content is preferably set to 0.3% and further preferably set to 0.15%. On the other hand, in order to ensure the above-described effects due to Y, the lower limit of the Y content is preferably set to 0.0005%. The lower limit of the Y content is more preferably 0.001% and still more preferably 0.002%.

La: 0.5% or Less

La (lanthanum) has the effect of improving the hot workability by fixing S as sulfides. La also has the effect of improving the adhesiveness of a $Cr_2O_3$ protective film on the alloy surface, especially improving the oxidation resistance at the time of repeated oxidation, and further La has the effects of enhancing the creep rupture strength and creep rupture ductility by contributing to grain boundary strengthening. However, if the content of La exceeds 0.5%, the amounts of inclusions, such as oxides increase, so that the workability and weldability are impaired. Therefore, in the case where La is contained, the content of La is set to 0.5% or less. The upper limit of the La content is preferably set to 0.3% and further preferably set to 0.15%. On the other hand, in order to ensure the above-described effects due to La, the lower limit of the La content is preferably set to 0.0005%. The lower limit of the La content is more preferably 0.001% and still more preferably 0.002%.

Ce: 0.5% or Less

Ce (cerium) also has the effect of improving the hot workability by fixing S as sulfides. In addition, Ce has the effect of improving the adhesiveness of a $Cr_2O_3$ protective film on the alloy surface, especially improving the oxidation resistance at the time of repeated oxidation, and further Ce has the effects of enhancing the creep rupture strength and creep rupture ductility by contributing to grain boundary strengthening. However, if the content of Ce exceeds 0.5%, the amounts of inclusions, such as oxides increase, so that the workability and weldability are impaired. Therefore, in the case where Ce is contained, the content of Ce is set to 0.5% or less. The upper limit of the Ce content is preferably set to 0.3% and further preferably set to 0.15%. On the other hand, in order to ensure the above-described effects due to Ce, the lower limit of the Ce content is preferably set to 0.0005%. The lower limit of the Ce content is more preferably 0.001% and still more preferably 0.002%.

Nd: 0.5% or Less

Nd (neodymium) has the effect of improving the hot workability by fixing S as sulfides. Nd also has the effect of improving the adhesiveness of a $Cr_2O_3$ protective film on the alloy surface, especially improving the oxidation resistance at the time of repeated oxidation, and further Nd has the effects of enhancing the creep rupture strength and creep rupture ductility by contributing to grain boundary strengthening. However, if the content of Nd exceeds 0.5%, the amounts of inclusions, such as oxides increase, so that the workability and weldability are impaired. Therefore, in the case where Nd is contained, the content of Nd is set to 0.5% or less. The upper limit of the Nd content is preferably set to 0.3% and further preferably set to 0.15%. On the other hand, in order to ensure the above-described effects due to Nd, the lower limit of the Nd content is preferably set to 0.0005%. The lower limit of the Nd content is more preferably 0.001% and still more preferably 0.002%.

Sc: 0.5% or Less

Sc (scandium) also has the effect of improving the hot workability by fixing S as sulfides. In addition, Sc has the effect of improving the adhesiveness of a $Cr_2O_3$ protective film on the alloy surface, especially improving the oxidation resistance at the time of repeated oxidation, and further Sc has the effects of enhancing the creep rupture strength and creep rupture ductility by contributing to grain boundary strengthening. However, if the content of Sc exceeds 0.5%, the amounts of inclusions, such as oxides increase, so that the workability and weldability are impaired. Therefore, in the case where Sc is contained, the content of Sc is set to 0.5% or less. The upper limit of the Sc content is preferably set to 0.3% and further preferably set to 0.15%. On the other hand, in order to ensure the above-described effects due to Sc, the lower limit of the Sc content is preferably set to 0.0005%. The lower limit of the Sc content is more preferably 0.001% and still more preferably 0.002%.

The upper limit of the sum of contents of the above-described elements from Mg to Sc may be 2.6%. The upper limit of the sum of contents thereof is further preferably 1.5%.

Each of Ta, Re, Ir, Pr, Pt and Ag being elements of the ⟨3⟩ group, has the effect of solid solution strengthening by dissolving into the austenite, which is the matrix. Therefore, in a case where it is desired to obtain far higher strength by the solid solution strengthening action, these elements are added positively, and one or more elements among them may be contained in the range described below.

Ta: 8% or Less

Ta (tantalum) has the effects of enhancing the high temperature strength and creep rupture strength by dissolving into the austenite, which is the matrix, and by forming carbonitrides. Therefore, in order to obtain theses effects, Ta may be contained. However, if the content of Ta exceeds 8%, the workability and mechanical properties are impaired. Therefore, in the case where Ta is contained, the content of Ta is set to 8% or less. The upper limit of the Ta content is preferably set to 7% and more preferably set to 6%. On the other hand, in order to ensure the above-described effects due to Ta, the lower limit of the Ta content is preferably set to 0.01%. The lower limit of the Ta content is more preferably 0.1% and still more preferably 0.5%.

Re: 8% or Less

Re (rhenium) has the effects of enhancing the high temperature strength and creep rupture strength by dissolving into the austenite, which is the matrix. Therefore, in order to obtain theses effects, Re may be contained. However, if the Re content exceeds 8%, the workability and mechanical properties are impaired. Therefore, in the case where Re is contained, the content of Re is set to 8% or less. The upper limit of the Re content is preferably set to 7% and more preferably set to 6%. On the other hand, in order to ensure the above-described effects due to Re, the lower limit of the Re content is preferably set to 0.01%. The lower limit of the Re content is more preferably 0.1% and still more preferably 0.5%.

Ir: 5% or Less

Ir (iridium) has the effects of enhancing the high temperature strength and creep rupture strength by dissolving into the austenite, which is the matrix, and by forming fine intermetallic compounds according to the content. Therefore, in order to obtain theses effects, Ir may be contained. However, if the Ir content exceeds 5%, the workability and mechanical properties are impaired. Therefore, in the case where Ir is contained, the content of Ir is set to 5% or less. The upper limit of the Ir content is preferably set to 4% and more preferably set to 3%. On the other hand, in order to ensure the above-described effects due to Ir, the lower limit of the Ir content is preferably set to 0.01%. The lower limit of the Ir content is more preferably 0.05% and still more preferably 0.1%.

Pd: 5% or Less

Pd (palladium) has the effects of enhancing the high temperature strength and creep rupture strength by dissolving into the austenite, which is the matrix, and by forming fine intermetallic compounds according to the content. Therefore, in order to obtain theses effects, Pd may be contained. However, if the Pd content exceeds 5%, the workability and mechanical properties are impaired. Therefore, in the case where Pd is contained, the content of Pd is set to 5% or less. The upper limit of the Pd content is preferably set to 4% and more preferably set to 3%. On the other hand, in order to ensure the above-described effects due to Pd, the lower limit of the Pd content is preferably set to 0.01%. The lower limit of the Pd content is more preferably 0.05% and still more preferably 0.1%.

Pt: 5% or Less

Pt (platinum) also has the effects of enhancing the high temperature strength and creep rupture strength by dissolving into the austenite, which is the matrix, and by forming fine intermetallic compounds according to the content. Therefore, in order to obtain theses effects, Pt may be contained. However, if the Pt content exceeds 5%, the workability and mechanical properties are impaired. Therefore, in the case where Pt is contained, the content of Pt is set to 5% or less. The upper limit of the Pt content is preferably set to 4% and more preferably set to 3%. On the other hand, in order to ensure the above-described effects due to Pt, the lower limit of the Pt content is preferably set to 0.01%. The lower limit of the Pt content is more preferably 0.05% and still more preferably 0.1%.

Ag: 5% or Less

Ag (silver) has the effects of enhancing the high temperature strength and creep rupture strength by dissolving into the austenite, which is the matrix, and by forming fine intermetallic compounds according to the content. Therefore, in order to obtain theses effects, Ag may be contained. However, if the Ag content exceeds 5%, the workability and mechanical properties are impaired. Therefore, in the case where Ag is contained, the content of Ag is set to 5% or less. The upper limit of the Ag content is preferably set to 4% and more preferably set to 3%. On the other hand, in order to ensure the above-described effects due to Ag, the lower limit of the Ag content is preferably set to 0.01%. The lower limit of the Ag content is more preferably 0.05% and still more preferably 0.1%.

The sum of contents of the above-described elements from Ta to Ag is preferably 10% or less. The upper limit of the sum of contents thereof is further preferably 8%.

$$P \leq 3/\{200(Ti+8.5\times Zr)\}$$

Regarding the austenitic heat resistant alloy of the present invention, the contents of Ti, Zr and P each must be in an already-described range, and also must satisfy the following formula:

$$P \leq 3/\{200(Ti+8.5\times Zr)\} \quad (1),$$

The reason for this is as follows. Since Ti and Zr lower the melting point of the heat resistant alloy, and P deteriorates the hot workability, in the case where the contents of Ti, Zr and P are in the already-described ranges respectively but do not satisfy the above formula (1), the hot workability, especially the hot workability on the high temperature side of 1150° C. or higher deteriorates, and further the high temperature crack resistance at the time of welding may deteriorate. However, if the contents of Ti, Zr and P satisfy the above-described formula (1), the hot workability on the high temperature side of 1150° C. or higher can be improved stably and reliably, while the high creep rupture strength is maintained, and further, the high temperature crack resistance at the time of welding can also be improved.

$$1.35\times Cr \leq Ni \leq 1.85\times Cr, \text{or } 1.35\times Cr \leq Ni+Co \leq 1.85\times Cr$$

In a case where the content of Ni is in the already-described range and satisfies the following formula, $$1.35\times Cr \leq Ni \leq 1.85\times Cr \quad (2),$$

in relation to the Cr content, or, in a case where Co is compositely contained and the contents of both Ni and Co are in the already-described range and satisfy the following formula, $$1.35\times Cr \leq Ni+Co \leq 1.85\times Cr \quad (4);$$

in relation to the Cr content, the precipitation of σ phase during a long period of use at a high temperature can be restrained stably and reliably, and moreover, the optimum amount of the α-Cr phase can be precipitated. Therefore, the austenitic heat resistant alloy of the present invention is regulated to satisfy the formula (2) or formula (4).

$$Al \geq 1.5\times Zr$$

Regarding the austenitic heat resistant alloy of the present invention, the content of Al and Zr must be in the already-described range, and also must satisfy the following formula:

$$Al \geq 1.5\times Zr \quad (3);$$

The reason for this is that in a case where the contents of Al and Zr do not satisfy formula (3), though being in the already-described range, in some cases, the action of Zr for promoting the precipitation of the α-Cr phase to enhance the creep rupture strength cannot be ensured sufficiently. However, if the contents of Al and Zr satisfy formula (3), the action of Zr for promoting the precipitation of the α-Cr phase to enhance the creep rupture strength can be performed stably and reliably.

As described above, the austenitic heat resistant alloy of the present invention is excellent in creep resistance properties and structural stability. Therefore, if this austenitic heat resistant alloy is used as a starting material, a heat resistant pressure member excellent in creep resistance and structural stability in a high temperature range in accordance with the present invention, can be obtained easily. The austenitic heat resistant alloy of the present invention used as the starting material for the heat resistant pressure member of the present invention may be melted and cast in the same way as that of the ordinary austenitic alloy.

(B) Method for Manufacturing a Heat Resistant Pressure Member

Next, a preferred method for manufacturing the heat resistant pressure member, which is made from the austenitic heat resistant alloy of the present invention is explained. This manufacturing method has the feature of including the before-described steps (i), (ii) and (iii) performed in sequence.

Step (i): Heating to 1050 to 1250° C. at Least Once Before Final Hot or Cold Working In the method in accordance with the present invention, it is necessary to dissolve the precipitates in the alloy which precipitated during the working sufficiently, by heating at least once before the final hot or cold working. However, in the case where the heating temperature is lower than 1050° C., undissolved carbo-nitrides and/or oxides, which contain Ti and B, come to exist stably in the heated alloy. As a result, the existence thereof results in the accumulation of nonuniform strain in the next step and makes the recrystallization nonuniform in the final heat treatment of the step (iii). Moreover, the said undissolved carbo-nitrides and oxides themselves hinder a uniform recrystallization. On the other hand, if the heating is performed at a temperature more than 1250° C., high temperature intergranular fracture and lowering of ductility may be caused. Therefore, in the preferred method of the present invention, heating to 1050 to 1250° C. is performed at least once before the final hot or cold working. The preferable lower limit of the heating temperature is 1150° C., and the preferable upper limit thereof is 1230° C.

Step (ii): Carrying Out a Final Hot or Cold Plastic Working Such that the Reduction of Area is 10% or More The plastic working in step (ii) is carried out to give strains for promoting recrystallization in the next final heat treatment. In the case where the reduction of area is less than 10% in this working, a strain necessary for recrystallization cannot be obtained. Therefore, the plastic working is carried out so that the reduction of area is 10% or more. The preferable lower limit of the reduction of area is 20%. Since a larger reduction of area is better, the upper limit thereof is not defined; however, the maximum value thereof in the ordinary working is about 90%. This working step is a step that determines the size of product.

In the case where the final working after heating is a hot working, the finish temperature of the hot working is preferably set to 1000° C. or higher in order to avoid nonuniform deformation in the temperature range in which carbides precipitate. Moreover, the cooling condition after working is not subject to any special restriction; however, after the finish of the hot working, in order to restrain the precipitation of coarse carbo-nitrides, it is desirable to perform cooling at the highest possible cooling rate of 0.25° C./s or higher in the temperature range down to 500° C.

In the case where the working after heating is a cold working, the cold working may be performed once as the final working or may be performed a number of times. In the case where the cold working is performed a number of times, a cold working is performed after intermediate heat treatment, and the heat treatment temperature in the step (i) and the reduction of area of cold working in the step (ii) have only to be satisfied in the final cold working and in the previous intermediate heat treatment.

Step (iii): Carrying Out a Final Heat Treatment in which Cooling is Performed after Heating and Holding at a Temperature in the Range of 1100 to 1250° C.

If the heating temperature of this heat treatment is lower than 1100° C., a sufficient recrystallization does not occur. Moreover, grains become depressed working microstructures, so that the creep strength decreases. On the other hand, if heating is performed to a temperature more than 1250° C., high temperature intergranular fracture and lowering of ductility may be caused, and therefore, the temperature of the final product heat treatment is 1100 to 1250° C. The preferable heat treatment temperature is a temperature 10° C. or more higher than the heating temperature in the step (i).

The heat resistant pressure member of the present invention need not be made of a fine grain microstructure from the viewpoint of corrosion resistance. When it is desired to make the heat resistant pressure member a fine grain microstructure, the final heat treatment has only to be performed at a temperature of 10° C. or lower than the hot working finish temperature or at a temperature of 10° C. or lower than the above-described intermediate heat treatment temperature. After this final heat treatment, in order to restrain the precipitation of coarse carbo-nitrides, cooling is preferably performed at the highest possible cooling rate of 1° C./s or higher.

The following examples illustrate the present invention more specifically. These examples are, however, by no means limited to the scope of the present invention.

Examples

Austenitic alloys 1 to 17 and A to K, having the chemical compositions shown in Table 1, were melted by using a high-frequency vacuum melting furnace and cast to form 17 kg ingots each having an outside diameter of 100 mm.

The alloys 1 to 17 shown in Table 1 are alloys whose chemical compositions fall within the range regulated by the present invention. On the other hand, the alloys A to K are alloys of comparative examples whose chemical composition are out of the range regulated by the present invention. Both of the alloys G and H are alloys in which the individual contents of Ni and Co are within the range regulated by the present invention, the value of "Ni+Co" does not satisfy the said formula (4). The alloy I is an alloy whose Al content of 0.03% is within the range of "0.01 to 0.3%" which is regulated by the present invention; but the said content of Al does not satisfy the formula (3). The alloy K is an alloy whose P content of 0.009% is within the range of "0.03 or less" which is regulated by the present invention; however the said content of P does not satisfy the formula (1).

TABLE 1

| | Chemical composition (% by mass) Balance: Fe and impurities | | | | | | | | | | | | |
|---|---|---|---|---|---|---|---|---|---|---|---|---|---|
| Alloy | C | Si | Mn | P | S | Cr | Ni | Co | Ni + Co | Mo | W | Ti | Al |
| 1 | 0.057 | 0.43 | 1.05 | 0.011 | 0.003 | 29.2 | 47.8 | — | 47.8 | — | 4.3 | 0.43 | 0.12 |
| 2 | 0.059 | 0.41 | 1.07 | 0.008 | 0.002 | 31.3 | 50.2 | — | 50.2 | — | 7.9 | 0.72 | 0.16 |
| 3 | 0.056 | 0.44 | 1.11 | 0.005 | 0.002 | 31.0 | 53.4 | — | 53.4 | — | 11.6 | 0.53 | 0.21 |
| 4 | 0.062 | 0.39 | 0.95 | 0.012 | 0.003 | 35.2 | 56.5 | — | 56.5 | — | 6.8 | 0.71 | 0.08 |
| 5 | 0.059 | 0.37 | 1.20 | 0.006 | 0.002 | 30.4 | 43.4 | 7.2 | 50.6 | — | 8.1 | 0.82 | 0.25 |
| 6 | 0.060 | 0.43 | 1.08 | 0.011 | 0.001 | 35.8 | 42.4 | 14.5 | 66.9 | — | 10.5 | 0.65 | 0.14 |
| 7 | 0.055 | 0.41 | 0.41 | 0.008 | 0.003 | 30.5 | 50.3 | — | 50.3 | — | 7.6 | 0.74 | 0.13 |
| 8 | 0.061 | 0.38 | 1.85 | 0.012 | 0.002 | 30.2 | 51.0 | — | 51.0 | — | 8.5 | 0.55 | 0.14 |
| 9 | 0.055 | 0.50 | 1.02 | 0.025 | 0.0004 | 34.8 | 54.9 | — | 54.9 | — | 6.6 | 0.19 | 0.11 |
| 10 | 0.089 | 0.39 | 1.08 | 0.010 | 0.002 | 29.7 | 50.3 | — | 50.3 | — | 7.8 | 0.59 | 0.12 |
| 11 | 0.058 | 0.42 | 1.05 | 0.006 | 0.002 | 30.4 | 50.1 | — | 50.1 | — | 8.0 | 0.81 | 0.17 |
| 12 | 0.134 | 0.41 | 1.12 | 0.005 | 0.003 | 30.8 | 50.5 | — | 50.5 | — | 7.5 | 0.74 | 0.20 |
| 13 | 0.074 | 0.44 | 1.17 | 0.011 | 0.001 | 35.7 | 58.1 | — | 58.1 | — | 6.8 | 0.77 | 0.10 |
| 14 | 0.056 | 1.23 | 0.34 | 0.010 | 0.002 | 30.2 | 51.2 | — | 51.2 | — | 5.4 | 0.70 | 0.12 |
| 15 | 0.059 | 0.50 | 1.52 | 0.010 | 0.002 | 30.5 | 50.7 | — | 50.7 | — | 7.1 | 0.85 | 0.15 |
| 16 | 0.061 | 0.45 | 1.10 | 0.008 | 0.001 | 30.9 | 50.6 | — | 50.6 | — | 8.1 | 0.75 | 0.14 |
| 17 | 0.058 | 0.47 | 1.08 | 0.007 | 0.002 | 31.2 | 50.4 | — | 50.4 | — | 7.7 | 0.70 | 0.16 |
| A | 0.061 | 0.40 | 1.01 | 0.007 | 0.002 | 31.0 | 49.9 | — | 49.9 | — | 8.0 | 0.75 | 0.16 |
| B | 0.057 | 0.43 | 1.06 | 0.007 | 0.002 | 31.2 | 50.1 | — | 50.1 | — | 8.1 | *— | 0.14 |
| C | 0.060 | 0.44 | 1.07 | 0.010 | 0.003 | 30.1 | 48.1 | — | 48.1 | — | *2.7 | 0.45 | 0.14 |
| D | 0.060 | 0.41 | 1.01 | 0.010 | 0.002 | 31.5 | 49.9 | — | 49.9 | — | 8.0 | 0.74 | 0.15 |

TABLE 1-continued

| | | | | | | | | | | | | | |
|---|---|---|---|---|---|---|---|---|---|---|---|---|---|
| E | 0.062 | 0.41 | 1.10 | 0.008 | 0.003 | 31.1 | 50.5 | — | 50.5 | *2.5 | *— | 0.75 | 0.14 |
| F | 0.061 | 0.47 | 0.99 | 0.010 | 0.002 | 31.0 | 50.4 | — | 50.4 | *2.2 | 3.4 | 0.72 | 0.16 |
| G | 0.057 | 0.37 | 1.18 | 0.008 | 0.003 | 32.0 | 40.2 | 2.4 | *42.6 | — | 7.5 | 0.78 | 0.13 |
| H | 0.059 | 0.39 | 1.15 | 0.006 | 0.002 | 29.2 | 52.1 | 7.3 | *59.4 | — | 8.1 | 0.84 | 0.25 |
| I | 0.060 | 0.43 | 1.07 | 0.009 | 0.003 | 31.1 | 50.5 | — | 50.5 | — | 8.2 | 0.74 | *0.03 |
| J | 0.062 | 0.43 | 1.10 | 0.011 | 0.002 | 31.0 | 50.7 | — | 50.7 | — | 7.8 | 0.71 | *0.64 |
| K | 0.061 | 0.38 | 1.17 | *0.009 | 0.002 | 30.2 | 44.5 | 7.6 | 52.1 | — | 7.8 | 0.89 | 0.25 |

| | Chemical composition (% by mass) Balance: Fe and impurities | | | | | |
|---|---|---|---|---|---|---|
| Alloy | N | Zr | Others | value of f1 | value of f2 | value of f3 |
| 1 | 0.009 | 0.04 | — | 0.019 | 1.637 | 0.060 |
| 2 | 0.013 | 0.05 | — | 0.013 | 1.604 | 0.075 |
| 3 | 0.011 | 0.13 | — | 0.009 | 1.723 | 0.195 |
| 4 | 0.012 | 0.02 | B: 0.0063 | 0.017 | 1.605 | 0.030 |
| 5 | 0.008 | 0.13 | — | 0.008 | 1.664 | 0.195 |
| 6 | 0.014 | 0.03 | B: 0.0041 | 0.017 | 1.589 | 0.045 |
| 7 | 0.012 | 0.02 | V: 0.78, Nb: 0.32, B: 0.0026 | 0.016 | 1.649 | 0.030 |
| 8 | 0.011 | 0.04 | B: 0.033, Mg: 0.0023, Ca: 0.0028 | 0.017 | 1.689 | 0.060 |
| 9 | 0.010 | 0.02 | B: 0.0043, Y: 0.02, La: 0.03 | 0.042 | 1.578 | 0.030 |
| 10 | 0.012 | 0.03 | Nd: 0.03 | 0.018 | 1.694 | 0.045 |
| 11 | 0.005 | 0.03 | Co: 0.03, Sc: 0.05 | 0.014 | 1.648 | 0.045 |
| 12 | 0.007 | 0.05 | Hf: 0.28, Re: 1.2 | 0.013 | 1.640 | 0.075 |
| 13 | 0.005 | 0.02 | Ta: 1.3 | 0.016 | 1.627 | 0.030 |
| 14 | 0.012 | 0.03 | Ir: 1.2, Ag: 1.5 | 0.016 | 1.695 | 0.045 |
| 15 | 0.008 | 0.02 | Pd: 1.1, Pt: 1.0 | 0.015 | 1.662 | 0.030 |
| 16 | 0.018 | 0.04 | Ca: 0.035, Ta: 3.8 | 0.014 | 1.638 | 0.060 |
| 17 | 0.012 | 0.03 | B: 0.0031, Mg: 0.0041, Re: 2.4 | 0.016 | 1.615 | 0.045 |
| A | 0.013 | *— | — | 0.020 | 1.610 | — |
| B | 0.018 | 0.06 | — | 0.029 | 1.606 | 0.090 |
| C | 0.010 | 0.04 | — | 0.019 | 1.598 | 0.060 |
| D | *0.024 | 0.05 | — | 0.013 | 1.584 | 0.075 |
| E | 0.012 | 0.04 | — | 0.014 | 1.624 | 0.060 |
| F | 0.013 | 0.05 | — | 0.013 | 1.626 | 0.075 |
| G | 0.007 | 0.04 | — | 0.013 | 1.331 | 0.060 |
| H | 0.008 | 0.12 | — | 0.008 | 2.034 | 0.180 |
| I | 0.014 | 0.05 | — | 0.013 | 1.624 | 0.075 |
| J | 0.013 | 0.04 | — | 0.014 | 1.635 | 0.060 |
| K | 0.008 | 0.15 | — | 0.007 | 1.725 | 0.225 |

$f1 = 3/\{200(Ti + 8.5 \times Zr)\}$,
$f2 = (Ni + Co)/Cr$,
$f3 = 1.5 \times Zr$
The mark * indicates falling outside the conditions regulated by the present invention.

Thus the obtained ingot was heated to 1180° C., and then was hot forged so that the finish temperature was 1050° C. to form a plate material having a thickness of 15 mm. After the hot forging, the plate material was air cooled.

From a middle portion in the thickness direction of the 15 mm thick plate material obtained by the above-mentioned hot forging, a round bar tensile test specimen, having a diameter of 10 mm and a length of 130 mm, was produced by machining the plate material in parallel to the longitudinal direction, and the tensile test specimen was used to evaluate the high temperature ductility.

That is to say, the said round bar tensile test specimen was heated to 1200° C. and was held for 3 minutes, and then a high speed tensile test was conducted at a strain rate of 10/s in order to determine the reduction of area from the fracture surface after testing. It was found that if the reduction of area is 60% or more, no major problem occurred, even if hot working, such as hot extrusion is performed at that temperature. Therefore, the reduction of area of "60% or more" was made the criterion of excellent hot workability.

Moreover, using the 15 mm thick plate material obtained by the said hot forging, a softening heat treatment was performed at 1100° C., and then the plate material was cold rolled so that the thickness thereof becomes 10 mm, and further, the cold rolled plate material was water cooled after being held at 1200° C. for 30 minutes.

Using a part of the above-described 10 mm thick plate material water cooled after being held at 1200° C. for 30 minutes, and from a middle portion in the thickness direction of the part, a round bar tensile test specimen, having a diameter of 6 mm and a gage length of 30 mm, was produced by machining the part in parallel to the longitudinal direction; the tensile test specimen was used to conduct a creep rupture test.

That is to say, by using the above-described test specimen, the creep rupture test was conducted in the air of 700° C., 750° C. and 800° C., and by generalizing the obtained rupture strength using the Larson-Miller parameter method, the rupture strength at 700° C. in 10,000 hours was determined.

Furthermore, the remainder of the 10 mm thick plate material water cooled after being held at 1200° C. for 30 minutes was subjected to an aging treatment in which the test specimen was held at 750° C. for 5000 hours, and then was water cooled.

From a middle portion in the thickness direction of the 10 mm thick plate material water cooled after an aging treatment, a V-notch test specimen having a width of 5 mm, a height of 10 mm, and a length of 55 mm, specified in JIS Z 2242 (2005) was produced in parallel to the longitudinal direction, and a Charpy impact test at 0° C. was conducted on the test specimen in order to measure the impact value and evaluate the toughness.

The results of the above-described tests are summarized in Table 2.

TABLE 2

| Test No. | Alloy | Creep rupture strength at 700° C. × 10000 h (MPa) | Charpy impact value (J/cm$^2$) | Reduction of area at 1200° C. (%) | Note |
|---|---|---|---|---|---|
| 1 | 1 | 158.4 | 63.4 | 86.5 | Inventive example |
| 2 | 2 | 165.2 | 55.6 | 80.4 | |
| 3 | 3 | 168.5 | 48.3 | 85.2 | |
| 4 | 4 | 170.1 | 57.4 | 80.8 | |
| 5 | 5 | 169.3 | 51.2 | 71.5 | |
| 6 | 6 | 172.2 | 41.3 | 72.6 | |
| 7 | 7 | 169.5 | 53.5 | 81.0 | |
| 8 | 8 | 164.1 | 56.2 | 88.7 | |
| 9 | 9 | 155.3 | 59.0 | 92.5 | |
| 10 | 10 | 163.5 | 57.8 | 90.1 | |
| 11 | 11 | 166.4 | 55.9 | 85.6 | |
| 12 | 12 | 165.0 | 56.0 | 81.2 | |
| 13 | 13 | 171.2 | 57.6 | 81.1 | |
| 14 | 14 | 165.4 | 58.5 | 81.9 | |
| 15 | 15 | 167.2 | 53.7 | 71.8 | |
| 16 | 16 | 168.3 | 54.8 | 86.2 | |
| 17 | 17 | 167.9 | 55.0 | 87.1 | |
| 18 | * A | 142.5 | 55.8 | 80.8 | Comparative example |
| 19 | * B | 135.1 | 55.1 | 85.3 | |
| 20 | * C | 148.9 | 63.9 | 86.2 | |
| 21 | * D | 151.5 | 51.6 | 78.8 | |
| 22 | * E | 141.1 | 11.5 | 80.6 | |
| 23 | * F | 143.5 | 13.4 | 81.0 | |
| 24 | * G | 148.5 | 15.2 | 79.8 | |
| 25 | * H | 139.6 | 52.8 | 71.1 | |
| 26 | * I | 151.9 | 51.9 | 81.2 | |
| 27 | * J | 164.9 | 24.8 | 52.3 | |
| 28 | * K | 169.0 | 50.7 | 50.2 | |

The mark * indicates falling outside the conditions regulated by the present invention.

From Table 2, regarding the test Nos. 1 to 17 using the alloys 1 to 17, which are the inventive examples, it is apparent that all of the creep rupture strength, toughness after aging, and hot workability are excellent.

In contrast, regarding the test Nos. 18 to 28 using the alloys A to K, which are the comparative examples deviating from the conditions regulated by the present invention, at least one of the creep rupture strength, toughness after aging, and hot workability is poorer than that of the above-mentioned test Nos. 1 to 17, being the inventive examples That is to say, in the case of test No. 18, the chemical composition of the alloy A is almost equivalent to that of the alloy 2, used in the test No. 2. However, the said alloy A does not contain Zr, and therefore the creep rupture strength is low.

In the case of test No. 19, the chemical composition of the alloy B is almost equivalent to that of the alloy 2, used in the test No. 2. However, the said alloy B does not contain Ti, and therefore the creep rupture strength is low.

In the case of test No. 20, the chemical composition of the alloy C is almost equivalent to that of the alloy 1, used in the test No. 1. However, the W content of the said alloy C is "2.7%", which is lower than the value regulated by the present invention, and therefore the creep rupture strength is low.

In the case of test No. 21, the chemical composition of the alloy D is almost equivalent to that of the alloy 2, used in the test No. 2. However, the N content of the said alloy D is "0.024%", which is higher than the value regulated by the present invention, and therefore the creep rupture strength is low.

In the case of test No. 22, the chemical composition of the alloy E is almost equivalent to that of the alloy 2, used in the test No. 2. However the said alloy E does not contain W, and moreover the Mo content thereof is "2.5%", which is higher than the value regulated by the present invention. Therefore, the creep rupture strength is low, and further the Charpy impact value after aging is remarkably low, so that the toughness is poor.

In the case of test No. 23, if the operational advantage of W is about a half of that of Mo, that is to say, if the W content corresponds to about a half of the Mo content, as being said conventionally, the alloy F is an alloy which is equivalent to the alloy 2, used in the test No. 2. However, the Mo content of the said alloy F is "2.2%", which exceeds the value regulated by the present invention. Therefore, the creep rupture strength is low, and further the Charpy impact value after aging is remarkably low, so that the toughness is poor.

In the case of test No. 24, the chemical composition of the alloy G is almost equivalent to that of the alloy 5, used in the test No. 5. However the sum of the Ni content and the Co content, that is to say, the value of "Ni+Co" of the said alloy G is lower than "1.35×Cr" and does not satisfy the formula (4). Therefore, the creep rupture strength is low, and moreover the Charpy impact value after aging is remarkably low, so that the toughness is poor.

In the case of test No. 25, the chemical composition of the alloy H is almost equivalent to that of the alloy 5, used in the test No. 5. However, the sum of the Ni content and the Co content, that is to say, the value of "Ni+Co" of the said alloy H is higher than "1.85×Cr" and does not satisfy the formula (4). Therefore, the creep rupture strength is low.

In the case of test No. 26, the chemical composition of the alloy I is almost equivalent to that of the alloy 2, used in the test No. 2. However, the Al content of the said alloy I is lower than "1.5×Zr" and does not satisfy the formula (3). Therefore, the creep rupture strength is low.

In the case of test No. 27, the chemical composition of the alloy J is almost equivalent to that of the alloy 2, used in test No. 2. However, the Al content of the said alloy J is "0.64%", which is higher than the value regulated by the present invention. Therefore, the Charpy impact value after aging is remarkably low, so that the toughness is poor. Moreover the reduction of area at 1200° C. does not reach 60%, so that the hot workability is low.

In the case of test No. 28, the chemical composition of the alloy K is almost equivalent to that of the alloy 5, used in the test No. 5. However, the P content of the said alloy K exceeds "3/{200(Ti+8.5×Zr)}" and does not satisfy the formula (1). Therefore, the reduction of area at 1200° C. is 50.2%, so that the hot workability is remarkably low.

INDUSTRIAL APPLICABILITY

The austenitic heat resistant alloy according to the present invention, has high temperature strength, especially creep rupture strength, higher than that of the conventional heat resistant alloys, and also has high toughness because the structural stability is excellent even after a long period of use at a high temperature. Further it is excellent in hot workability, especially high temperature ductility at 1150° C. or higher. Therefore, this austenitic heat resistant alloy can be suitably used as a pipe material, a plate material for a heat resistant pressure member, a bar material, forgings, and the like for a boiler for power generation, a plant for chemical industry and so on.

What is claimed is:

1. A method for manufacturing a heat resistant pressure member excellent in creep resistance and structural stability in a high temperature range which is made from an austenitic heat resistant alloy comprising, by mass percent, C: more than 0.02% to not more than 0.15%, Si: 2% or less, Mn: 3% or less, P: 0.03% or less, S: 0.01% or less, Cr: more than 30% to 38%, Ni: more than 40% to not more than 60%, Co: 7.2 to 20%, W: more than 3% to not more than 15%, Ti: 0.53 to 1.0%, Zr: 0.005 to 0.2%, Al: 0.01 to 0.3%, N: 0.02% or less, and Mo: less than 0.5%, with the balance being Fe and impurities, in which the following formulas (1), (3) and (4) are satisfied:

$$P \leq 3/\{200(Ti+8.5\times Zr)\} \quad (1),$$

$$Al \geq 1.5\times Zr \quad (3),$$

$$1.35\times Cr \leq Ni+Co \leq 1.85\times Cr \quad (4);$$

wherein each element symbol in the formulas (1), (3) and (4) represents the content by mass % of the element concerned, and wherein the austenitic heat resistant alloy is treated in sequence by the following steps (i), (ii) and (iii):

step (i): heating to 1050 to 1250° C. at least once before final hot or cold working;

step (ii): carrying out a final hot or cold plastic working such that a reduction of area is 10% or more;

step (iii): carrying out a final heat treatment in which cooling is performed after heating and holding at a temperature in the range of 1100 to 1250° C.

2. A method for manufacturing the heat resistant pressure member excellent in creep resistance and structural stability in a high temperature range according to claim 1, wherein the austenitic heat resistant alloy further contains, by mass percent, one or more elements of one or more groups selected from the ⟨1⟩ to ⟨3⟩ groups listed below in lieu of a part of Fe:

⟨1⟩ Nb: 1.0% or less, V: 1.5% or less, Hf: 1% or less and B: 0.05% or less;

⟨2⟩ Mg: 0.05% or less, Ca: 0.05% or less, Y: 0.5% or less, La: 0.5% or less, Ce: 0.5% or less, Nd: 0.5% or less and Sc: 0.5% or less;

⟨3⟩ Ta: 8% or less, Re: 8% or less, Ir: 5% or less, Pd: 5% or less, Pt: 5% or less and Ag: 5% or less.

* * * * *